US009531489B2

(12) United States Patent
Bae

(10) Patent No.: US 9,531,489 B2
(45) Date of Patent: Dec. 27, 2016

(54) BROADCASTING SIGNAL RECEIVING APPARATUS AND CONTROL METHOD THEREOF

(71) Applicant: SAMSUNG ELECTRONICS CO., LTD., Suwon-si (KR)

(72) Inventor: Bum-youl Bae, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/735,855

(22) Filed: Jun. 10, 2015

(65) Prior Publication Data

US 2015/0381295 A1 Dec. 31, 2015

(30) Foreign Application Priority Data

Jun. 27, 2014 (KR) ..... 10-2014-0079688

(51) Int. Cl.
*H04H 20/71* (2008.01)
*H04H 40/90* (2008.01)

(52) U.S. Cl.
CPC ..... *H04H 40/90* (2013.01); *H04H 2201/60* (2013.01)

(58) Field of Classification Search
CPC ..... H04H 20/74; H04H 40/90; H04H 2201/60
See application file for complete search history.

(56) References Cited

U.S. PATENT DOCUMENTS 3,699,456 A * 10/1972 Midgley ..... H03J 1/066 455/158.1
5,572,213 A * 11/1996 Noneman ..... H04B 1/0007 342/13
6,868,292 B2 3/2005 Ficco et al.
6,922,845 B2 7/2005 Yap et al.
7,542,715 B1 * 6/2009 Gurantz ..... H04H 40/90 455/179.1
8,209,726 B2 6/2012 Nadarajah et al.
2005/0034159 A1 2/2005 Ophir et al.
2005/0055723 A1 3/2005 Atad et al.
2006/0174282 A1 8/2006 Dennison et al.
2008/0098450 A1 4/2008 Wu et al.
2008/0165285 A1 * 7/2008 Thompson ..... H04N 21/43637 348/554
2010/0231794 A1 * 9/2010 Robertson ..... H03M 1/185 348/572
2011/0023077 A1 1/2011 Simon
2013/0077544 A1 3/2013 Gomez et al.
2013/0127665 A1 5/2013 Miller et al.
2013/0205349 A1 8/2013 Chang et al.

* cited by examiner

*Primary Examiner* — Mohammed Rachedine
(74) *Attorney, Agent, or Firm* — Sughrue Mion, PLLC

(57) ABSTRACT

Disclosed is a broadcasting signal receiving apparatus including: at least one first input port, and a second input port which is provided separately from the first input port, the at least one first input port and the second input port are configured to receive a broadcasting signal; at least one first tuner configured to process the broadcasting signal; a first main switch configured to selectively connect the second input port with the at least one first tuner; and a controller configured to control the first main switch so that a first broadcasting signal received in the at least one first input port or a second broadcasting signal received in the second input port is input to the at least one first tuner.

14 Claims, 8 Drawing Sheets

BROADCASTING SIGNAL RECEIVING APPARATUS AND CONTROL METHOD THEREOF

CROSS-REFERENCE TO RELATED APPLICATION

This application claims priority from Korean Patent Application No. 10-2014-0079688, filed on Jun. 27, 2014 in the Korean Intellectual Property Office, the disclosure of which is incorporated herein by reference.

BACKGROUND

Field

Apparatuses and methods consistent with the exemplary embodiments relate to a broadcasting signal receiving apparatus and a control method thereof, and more particularly to a broadcasting signal receiving apparatus using a plurality of tuners to receive a broadcasting signal and a control method thereof.

Description of the Related Art

In a broadcasting signal receiving apparatus of the related art, a set-top box increasingly uses multi-tuners with the development of data transmission technology for hi quality and mass data, and development of a gate-way product having home automation, multi-screen functions, and the like.

For example, a related art satellite set-top box for receiving a satellite broadcasting signal may selectively process two kinds of signals (without processing both of them at a same time) according to a characteristic of a satellite broadcasting signal. At this time, tuners may be connected for receiving the respective signals.

In the related art satellite set-top box, if a cable is connected to one input port among a plurality of input ports (not each input port of the plurality of input ports) in order to receive a plurality of satellite broadcasting signals, a tuner operates which corresponds to the connected input port. However, the other tuners which correspond to the disconnected input ports do not operate. Therefore, the related art satellite set-top box has a disadvantage that not all of the plurality of tuners operate if the cable is connected to only one input port among the plurality of input ports to receive the plurality of broadcasting signal.

SUMMARY

An aspect of an exemplary embodiment provides a broadcasting signal receiving apparatus which includes a plurality of tuners which correspond to a plurality of broadcasting signals and receive the broadcasting signals. Further, an aspect of an exemplary embodiment may provide the broadcasting signal receiving apparatus which receives the broadcasting signals through the plurality of tuners regardless of a plurality of input states of the broadcasting signals.

In accordance with an aspect of an exemplary embodiment, there is provided a broadcasting signal receiving apparatus including: at least one first input port, and a second input port which is provided separately from the at least one first input port, the at least one first input port and the second input port being configured to receive a broadcasting signal; at least one first tuner configured to process the broadcasting signal; a first main switch configured to selectively connect the second input port with the at least one first tuner; and a controller configured to control the first main switch so that a first broadcasting signal received in the at least one first input port or a second broadcasting signal received in the second input port is input to the at least one first tuner. Thus, in an exemplary embodiment, the switch is used so that the plurality of tuners can receive the broadcasting signals regardless of input states of the broadcasting signals.

The broadcasting signal receiving apparatus may further include a first sub switch configured to selectively connect a plurality of input terminals of a plurality of first tuners with each other, and the controller may be configured to control the first sub switch so that the broadcasting signal is selectively input to the plurality of first tuners. Thus, in an exemplary embodiment of the broadcasting signal receiving apparatus with the plurality of tuners, the switch is used to selectively input the broadcasting signals to the respective tuners.

The controller may be configured to control the first sub switch so that the first broadcasting signal received in another one first input port among the plurality of first input ports is selectively input to the plurality of first tuners in response to the first broadcasting signal not being received in one first input port among the plurality of first input ports. Thus, in an exemplary embodiment of the broadcasting signal receiving apparatus with the plurality of tuners, the switch is used so that all the plurality of tuners can operate even though a cable is connected to one among the plurality of input ports.

The broadcasting signal receiving apparatus may further include: at least one second tuner configured to process the broadcasting signal; and a second main switch configured to selectively connect the at least one first input port and the at least one second tuner, and the controller may be configured to control the second main switch so that the first broadcasting signal or the second broadcasting signal is input to the at least one second tuner. Thus, in an exemplary embodiment including the plurality of tuners being connected and used, the switch is used so that the received broadcasting signals can be input to the plurality of unit tuners, thereby advantageously allowing the plurality of unit tuners to receive the broadcasting signals regardless of the input states of the broadcasting signal.

The controller may be configured to control the first main switch and the second main switch so that the second broadcasting signal received in one first input port among the plurality of first input ports is selectively input to a plurality of second tuners in response to the second broadcasting signal not being received in a plurality of second input ports. Thus, in an exemplary embodiment including the plurality of tuners being connected and used, the switch is used so that all the plurality of unit tuners can operate even though a cable is connected to one among the plurality of input ports.

The controller may be configured to control the first main switch and the second main switch so that the first broadcasting signal received in one first input port among the at least one first input port is input to the at least one second tuner. Thus, in an exemplary embodiment including the plurality of tuners being connected and used, the switch is used so that the broadcasting signal received in one among the plurality of input ports can be input to the plurality of unit tuners.

The controller may be configured to control the first main switch and the second main switch so that the first broadcasting signal input to the at least one first tuner is input to the at least one second tuner. Thus, in an exemplary embodiment including the plurality of tuners being connected and used, the switch is used so that the broadcasting signal input to one unit tuner can be input to another unit tuner.

The first broadcasting signal and the second broadcasting signal may include a plurality of signals transmitted from a satellite. Thus, in an exemplary embodiment, the plurality of tuners can be used through the switch so as to receive the broadcasting signal transmitted from a satellite.

A plurality of broadcasting signals input to a plurality of first tuners may be different from each other based on a voltage level. Thus, in an exemplary embodiment, the plurality of tuners can be used to receive the broadcasting signals that are different in a level of voltage and cannot be processed at a time, for example, to receive the satellite broadcasting signal.

An integrated circuit (IC) may include the at least one first tuner and the first sub switch. Thus, in an exemplary embodiment, while using the plurality of tuners, the switch connected between the respective tuners is used so that the plurality of tuners can operate at a time.

In accordance with an aspect of an exemplary embodiment, there is provided a method of controlling a broadcasting signal receiving apparatus, the method including: selectively connecting at least one first input port and a separately provided second input port with a first tuner using a first main switch; and controlling the first main switch so that a first broadcasting signal received in the at least one first input port or a second broadcasting signal received in the second input port is input to the first tuner.

The method may further include selectively connecting a plurality of input terminals of a plurality of first tuners with each other by a first sub switch, and controlling the first sub switch so that the broadcasting signal is selectively input to the plurality of first tuners.

The method may further include controlling the first sub switch so that the first broadcasting signal received in another one first input port among a plurality of first input ports is selectively input to the plurality of first tuners in response to the first broadcasting signal not being received in one first input port among the plurality of first input ports.

The method may further include selectively connecting the at least one first input port and a second tuner for processing the broadcasting signal by a second main switch, and controlling a second main switch so that the first broadcasting signal or the second broadcasting signal is input to the second tuner.

The method may further include controlling the first main switch and the second main switch so that the second broadcasting signal received in one first input port among the plurality of first input ports is selectively input to a plurality of second tuners in response to the second broadcasting signal not being received in a plurality of second input ports.

The method may further include controlling the first main switch and the second main switch so that the first broadcasting signal received in one first input port among the at least one first input port is input to the second tuner.

The method may further include controlling the first main switch and the second main switch so that the first broadcasting signal input to the first tuner is input to the second tuner.

The first broadcasting signal and the second broadcasting signal may include a plurality of signals transmitted from a satellite.

A plurality of broadcasting signals input to a plurality of first tuners may be different from each other based on a voltage level.

An integrated circuit (IC) may include the first tuner and the first sub switch.

In accordance with an aspect of an exemplary embodiment, there is provided a method of controlling a broadcasting signal receiving apparatus, the method including: determining whether a broadcasting signal is received through a cable; closing a first main switch and a first sub switch such that the broadcasting signal is input to a plurality of tuners in response to the broadcasting signal being received through the cable; and opening the first main switch such that the broadcasting signal is input to a tuner of the tuners which corresponds to an input port receiving the broadcasting signal in response to the broadcasting signal not being received through the cable.

BRIEF DESCRIPTION OF THE DRAWINGS

The above and/or other aspects will become apparent and more readily appreciated from the following description of exemplary embodiments, taken in conjunction with the accompanying drawings, in which.

DETAILED DESCRIPTION OF EXEMPLARY EMBODIMENTS

Hereinafter, exemplary embodiments will be described in detail with reference to accompanying drawings so as to be easily realized by a person having an ordinary skill in the art, but not limited to the following embodiments set forth herein. Descriptions about unrelated parts are omitted for clarity, and like numbers refer to like elements throughout.

Figure 1:
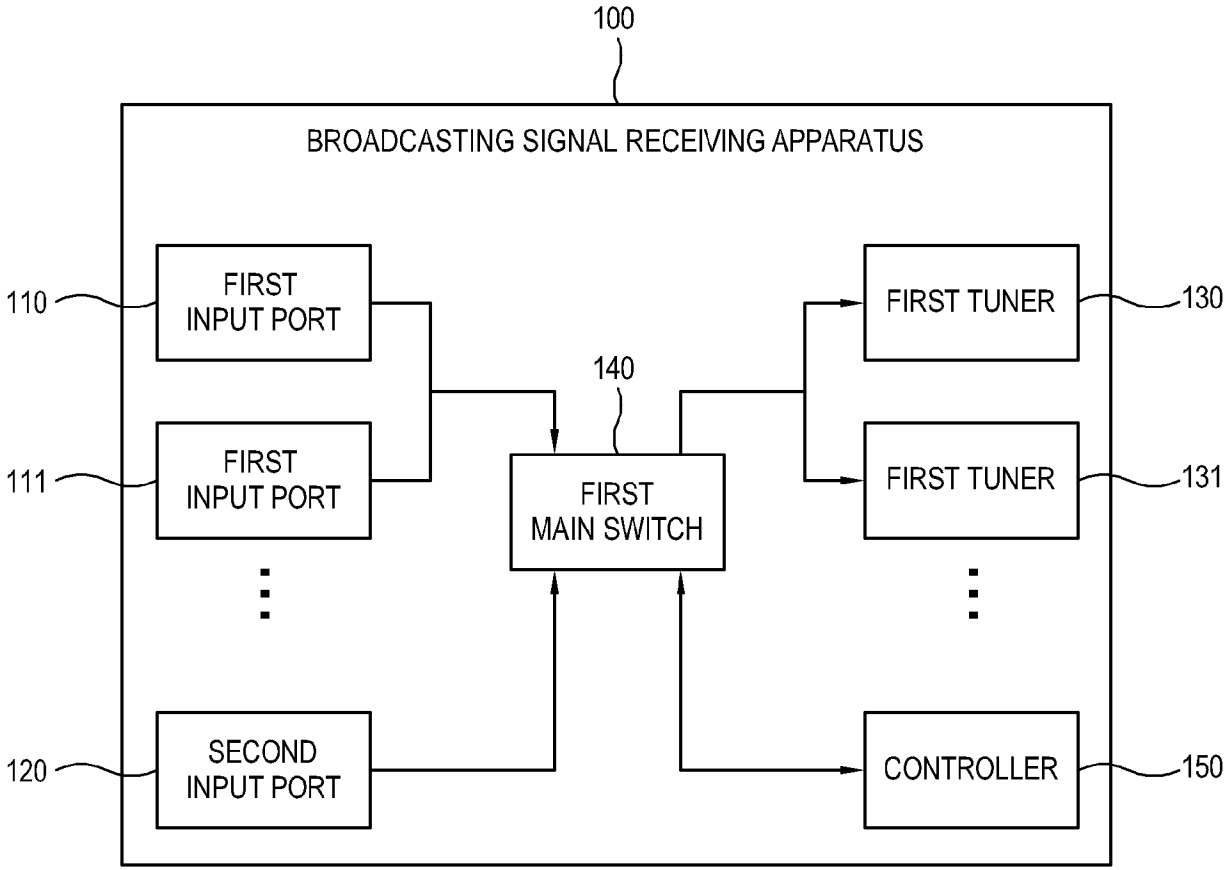
FIG. 1 is a block diagram of a broadcasting signal receiving apparatus according to an exemplary embodiment.

Hereinafter, elements of a broadcasting signal receiving apparatus according to exemplary embodiments will be described first with reference to FIG. 1, and then with reference to FIG. 4 as necessary. FIG. 1 is a block diagram of a broadcasting signal receiving apparatus according to an exemplary embodiment. As shown in FIG. 1, a broadcasting signal receiving apparatus 100 includes a first input port 110, 111, . . . , a second input port 120, a first tuner 130, 131, . . . , a first main switch 140, and a controller 150. The broadcasting signal receiving apparatus 100 may be achieved by a set-top box. In particular, the set-top box may receive a satellite broadcasting signal. Further, the set-top box may have a gate-way function. The broadcasting signal receiving apparatus 100 selectively connects the first input port 110, 111, . . . and separately provides the second input port 120 with the first tuners 130, 131, . . . , through the first main switch 140. At this time, if the first tuners 130, 131, . . . , are regarded as one unit tuner, the second input port 120 may be achieved by an input port corresponding to another unit tuner. The broadcasting signal receiving apparatus 100 controls the first main switch 140 so that first broadcasting signals received by the first input ports 110, 111, . . . , or a second broadcasting signal received by the second input port 120 can be input to the first tuners 130, 131, . . . .

According to an exemplary embodiment, the broadcasting signal receiving apparatus 100 can receive the broadcasting signals in the plurality of tuners through the switch regardless of input states of the broadcasting signals.

The first input ports 110, 111, . . . , and the second input port 120 receive the broadcasting signals external from the broadcasting signal receiving apparatus 100. At this time, the broadcasting signals received through the first input ports 110, 111, . . . , and the second input port 120 may be a broadcasting signal transmitted from a satellite, or a broadcasting signal transmitted from a cable network. However, the broadcasting signal is not limited to this exemplary embodiment. The first input ports 110, 111, . . . , and the second input port 120 may be provided on the outside (e.g., outside surface) of the broadcasting signal receiving apparatus 100, and plugged with cables for transmitting the broadcasting signals. The first input ports 110, 111, . . . , and the second input port 120 may correspond to the tuners, respectively.

The first tuners 130, 131, . . . , may receive a broadcasting signal through one channel among a plurality of channels. The channel for the broadcasting signal received by the first tuners 130, 131, . . . , may be selected by a user. The first tuners 130, 131, . . . , may further perform at least one signal processing process with regard to the received broadcasting signal. Alternatively, the broadcasting signal receiving apparatus 100 may further include an element for performing at least one signal processing process with regard to the signal received by the first tuners 130, 131, . . . . Such a signal processing process may include frequency tuning for selecting a channel.

The first main switch 140 selectively connects the second input port 120 with the first tuners 130, 131, . . . . If the first main switch 140 is opened, the second input port 120 is not connected to the first tuners 130, 131, . . . . If the first main switch 140 is closed, the second input port 120 is connected to the first tuners 130, 131, . . . .

The controller 150 controls the first main switch 140 so that the first broadcasting signals received by the first input ports 110, 111, . . . , or the second broadcasting signal received by the second input port 120 can be input to the first tuners 130, 131, . . . . At this time, the first broadcasting signal and the second broadcasting signal may be signals transmitted from satellites. Also, the broadcasting signals input to the plurality of first tuners 130, 131, . . . , may be different with respect to a voltage level. For example, if the received first and second broadcasting signals are the signals transmitted from the satellites, the voltage levels input to the respective tuners may be different (for example 18V and 13V, respectively). In this case, if it is impossible to process two kinds of signals having voltage levels of 18V and 13V through one tuner, a dual tuner may be used.

The controller 150 closes the first main switch 140 so that the second input port 120 can be connected to the first tuners 130, 131, . . . , thereby inputting the second broadcasting signal received by the second input port 120 to the first tuners 130, 131, . . . . . Also, the controller 150 opens the first main switch 140 so that the second input port 120 can be disconnected from the first tuners 130, 131, . . . , thereby inputting the first broadcasting signal received by the first input port 110, 111, . . . to the first tuners 130, 131, . . . .

Figure 4:
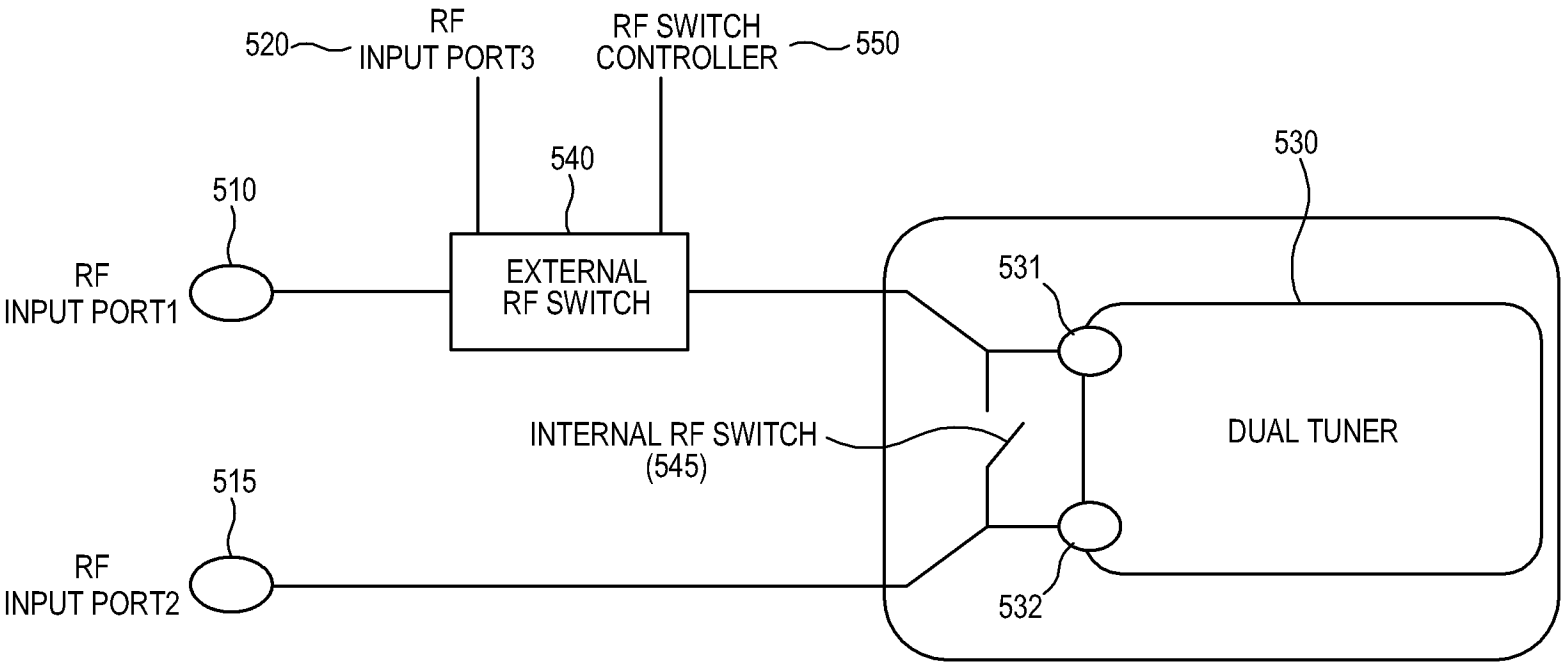
FIG. 4 shows an example where broadcasting signals are input to a dual tuner through three radio frequency (RF) input ports in the set-top box according to an exemplary embodiment.

For example, as shown in FIG. 4, if an external RF switch 540 (corresponding to the first main switch 140 shown in FIG. 1) is closed, an RF switch controller 550 (corresponding to a portion of the controller 150 shown in FIG. 1) controls the second broadcasting signal received in an RF input port3 520 (corresponding to the second input port 120 shown in FIG. 1) to be input to a dual tuner 530 (corresponding to the first tuners 130 and 131 shown in FIG. 1). Also, if the external RF switch 540 is opened, the RF switch controller 550 controls only the first broadcasting signal received in an RF input port1 510 to be input to the dual tuner 530, and the second broadcasting signal received in the RF input port3 520 is not input to the dual tuner 530.

Figure 2:
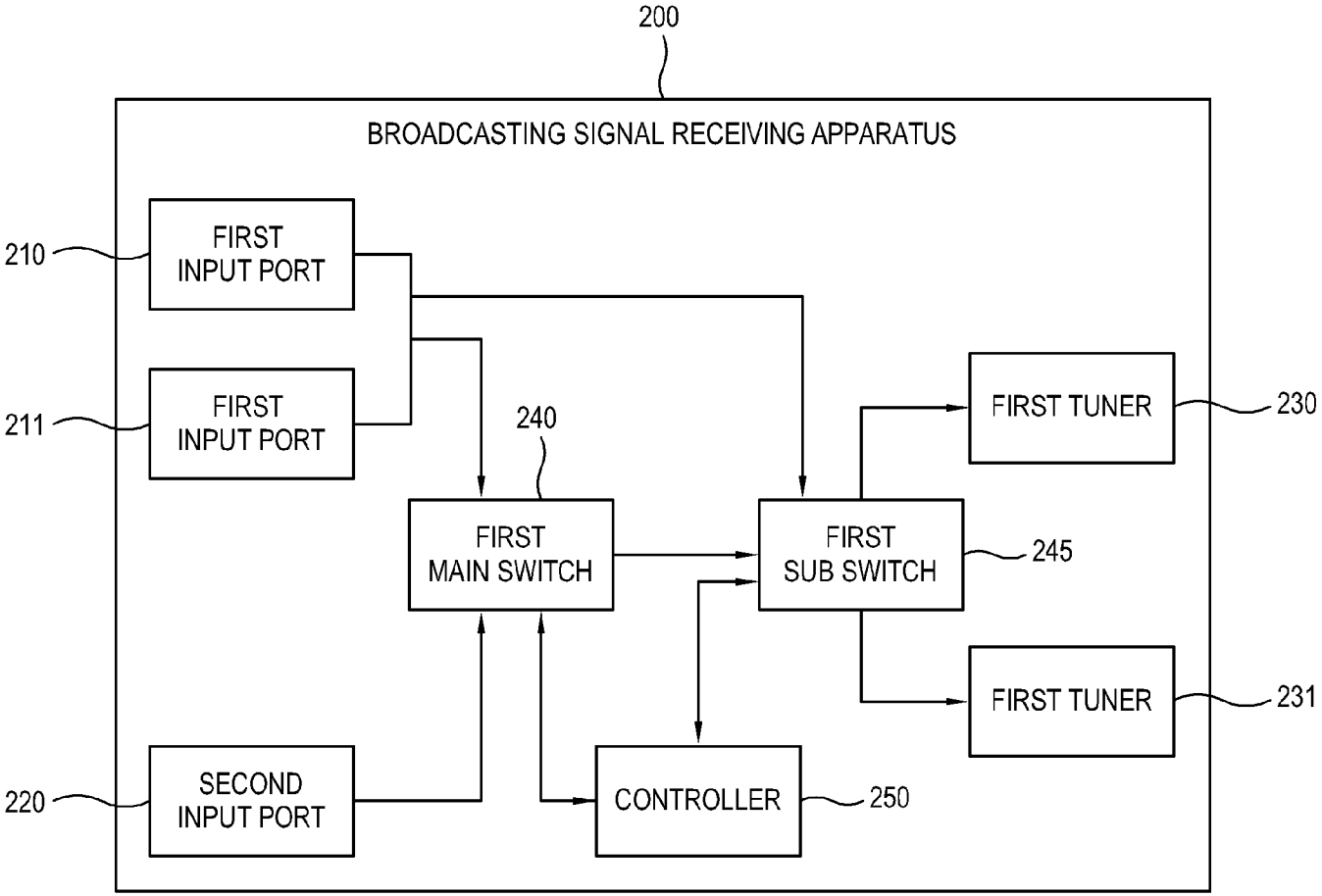
FIG. 2 is a block diagram of a broadcasting signal receiving apparatus including a first main switch and a first sub switch according to an exemplary embodiment.

FIG. 2 is a block diagram of a broadcasting signal receiving apparatus including a first main switch and a first sub switch according to an exemplary embodiment. As shown in FIG. 2, a broadcasting signal receiving apparatus 200 includes first input ports 210 and 211, a second input port 220, first tuner 230 and 231, a first main switch 240, and a controller 250 similar to the broadcasting signal receiving apparatus 100 shown in FIG. 1. FIG. 2 additionally includes a first sub switch 245 (in comparison to FIG. 1). The broadcasting signal receiving apparatus 200 includes two first input ports 210 and 211 and two first tuners 230 and 231, e.g. the dual tuner. However, exemplary embodiments are not limited thereto. Alternatively, broadcasting signal receiving apparatus 200 may include a plurality of first input ports 210, 211, . . . , and a plurality of first tuners 230, 231, . . . .

The first sub switch 245 selectively connects input terminals of two first tuners 230 and 231 with each other. If the first sub switch 245 becomes off (i.e., opened), the input terminal of the first tuner 230 is disconnected from the input terminal of the first tuner 231. If the first sub switch 245 becomes on (i.e., closed), the input terminal of the first tuner 230 is connected to the input terminal of the first tuner 231. The plurality of first tuners 231 and the first sub switch 245 may be merged (e.g., combined) into an integrated circuit (IC). In other words, the IC may include the plurality of first tuners 231 and the first sub switch 245. Thus, while using two or more tuners, the switch connected between the input terminals of the respective tuners may be used to operate the plurality of tuners at a time.

The controller 250 may control the first sub switch 245 to selectively input the broadcasting signal to the plurality of first tuners 230 and 231. The controller 250 controls the first sub switch 245 to become on so that the input terminal of the first tuner 230 can be connected to the input terminal of the first tuner 231, thereby inputting the broadcasting signal to the first tuner 230 or the first tuner 231. Also, the controller 250 controls the first sub switch 245 to become off so that the input terminal of the first tuner 230 can be disconnected from the input terminal of the first tuner 231, thereby inputting the broadcasting signals to only the corresponding tuner of the first tuners 230 and 231, respectively.

In particular, an example shown in FIG. 4 will be described. FIG. 4 shows an example where broadcasting signals are input to a dual tuner through three radio frequency (RF) input ports in the set-top box according to an exemplary embodiment. An RF input port1 510 and an RF input port2 515 correspond respectively to the first input port 210 and the first input port 211 of FIG. 2. An RF input port3 520 corresponds to the second input port 220 of FIG. 2. A dual tuner 530 corresponds to the first tuners 230 and 231 of FIG. 2. An external RF switch 540 and the internal RF switch 545 correspond respectively to the first main switch 240 and the first sub switch 245 of FIG. 2. An RF switch controller 550 corresponds to a portion of the controller 250 of FIG. 2.

As shown in FIG. 4, when the internal RF switch 545 becomes on, the input terminals 531 and 532 of the respective tuners provided in the dual tuner 530 are connected to each other so that the broadcasting signal received from the RF input port1 510 or the RF input port3 520 through the external RF switch 540 and the broadcasting signal received from the RF input port2 515 can be selectively input to two input terminals 531 and 532 of the dual tuner 530. Also, when the internal RF switch 545 becomes off, the input terminals 531 and 532 of the respective tuners included in the dual tuner 530 are not connected to each other so that the broadcasting signal received from the RF input port1 510 or the RF input port3 520 through the external RF switch 540 can be input to the input terminal 531 of the dual tuner 530 and the broadcasting signal received from the RF input port2 515 can be input to the input terminal 532 of the dual tuner 530.

If a first broadcasting signal is not received through one of the plurality of first input ports 210 and 211, the controller 250 may control the first sub switch 245 so that the first broadcasting signal received through the other one of the plurality of first input ports 210 and 211 can be selectively input to the plurality of first tuners 230 and 231. For example, as shown in FIG. 4, if a cable is connected to the RF input port1 510 and a cable is not connected to the RF input port2 515, the RF input port2 515 cannot receive the first broadcasting signal. In this case, the first broadcasting signal received in the RF input port1 510 can be input to the input terminal 532 of the dual tuner 530 closing the internal RF switch 545.

Figure 3:
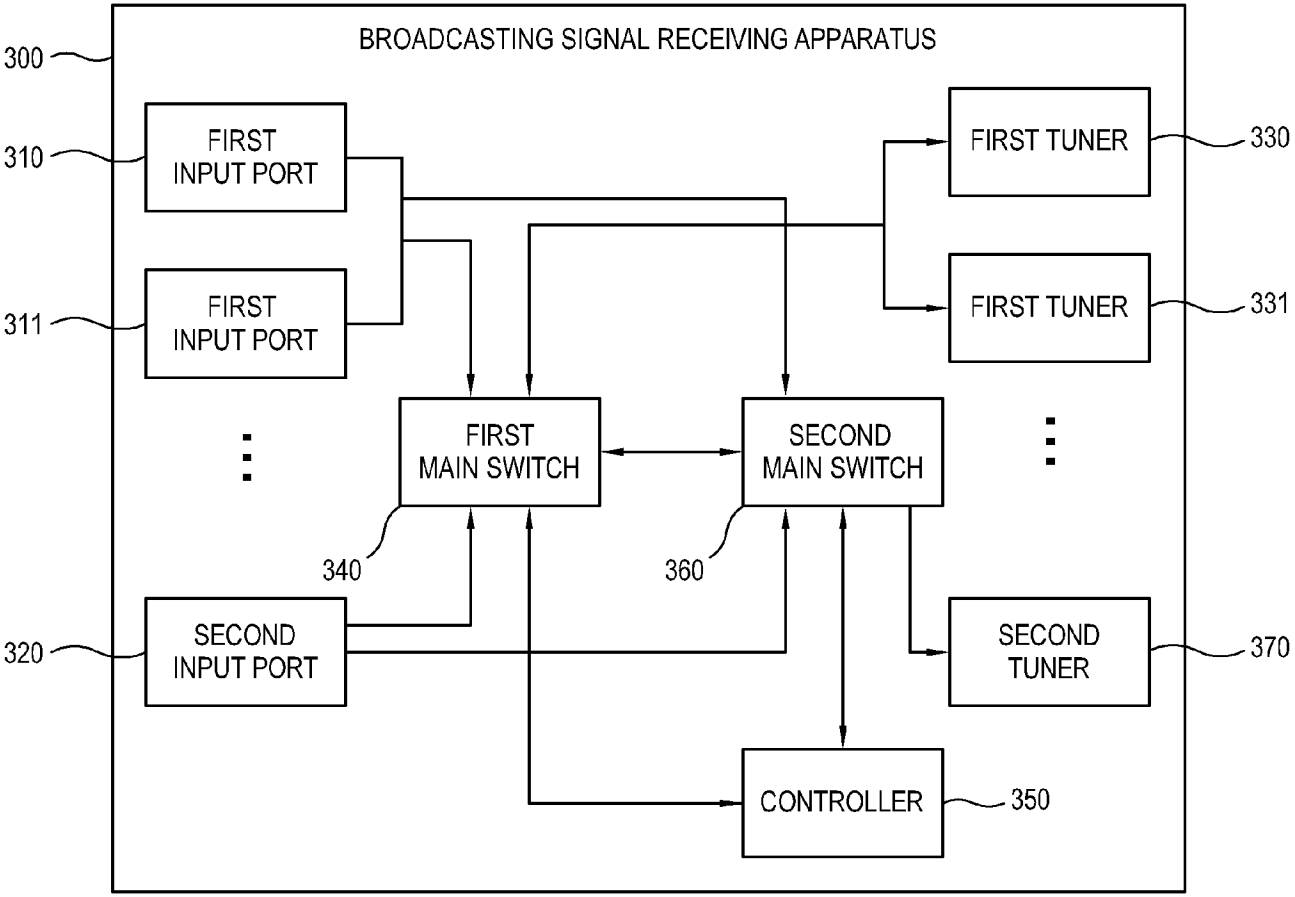
FIG. 3 is a block diagram of a broadcasting signal receiving apparatus including a first main switch and a second main switch according to an exemplary embodiment.

FIG. 3 is a block diagram of a broadcasting signal receiving apparatus including a first main switch and a second main switch according to an exemplary embodiment. As shown in FIG. 3, a broadcasting signal receiving apparatus 300 includes first input ports 310, 311, . . . , a second input port 320, first tuners 330, 331, . . . , a first main switch 340 and a controller 350 similar to the broadcasting signal receiving apparatus 100 shown in FIG. 1. FIG. 3 additionally includes a second tuner 370 and a second main switch 360 (in comparison to FIG. 1).

The second tuner 370 may process the broadcasting signals received in the broadcasting signal receiving apparatus 300 in accordance with a preset signal processing process like the first tuners 330, 331, . . . . For example, the signal processing process performed in the second tuner 370 may include frequency tuning for selecting a channel. The second main switch 360 selectively connects the first input ports 310, 311, . . . , and the second tuner 370. If the second main switch 360 is opened, the first input ports 310, 311, . . . , are disconnected from the second tuner 370. On the other hand, if the second main switch 360 is closed, the first input ports 310, 311, . . . , are connected to the second tuner 370.

The controller 350 may control the second main switch 360 to input a first broadcasting signal or a second broadcasting signal to the second tuner 370. The controller 350 controls the second main switch 360 to become on (i.e. closed) so that the first input ports 310, 311, . . . , can be connected to the second tuner 370, thereby inputting the first broadcasting signal received in the first input ports 310, 311, . . . , to the second tuner 370. Also, the controller 350 controls the second main switch 360 to become off (i.e., opened) so that the first input ports 310, 311, . . . , can be disconnected from the second tuner 370, thereby inputting the second broadcasting signal received in the second input port 320 to the second tuner 370.

Figure 5:
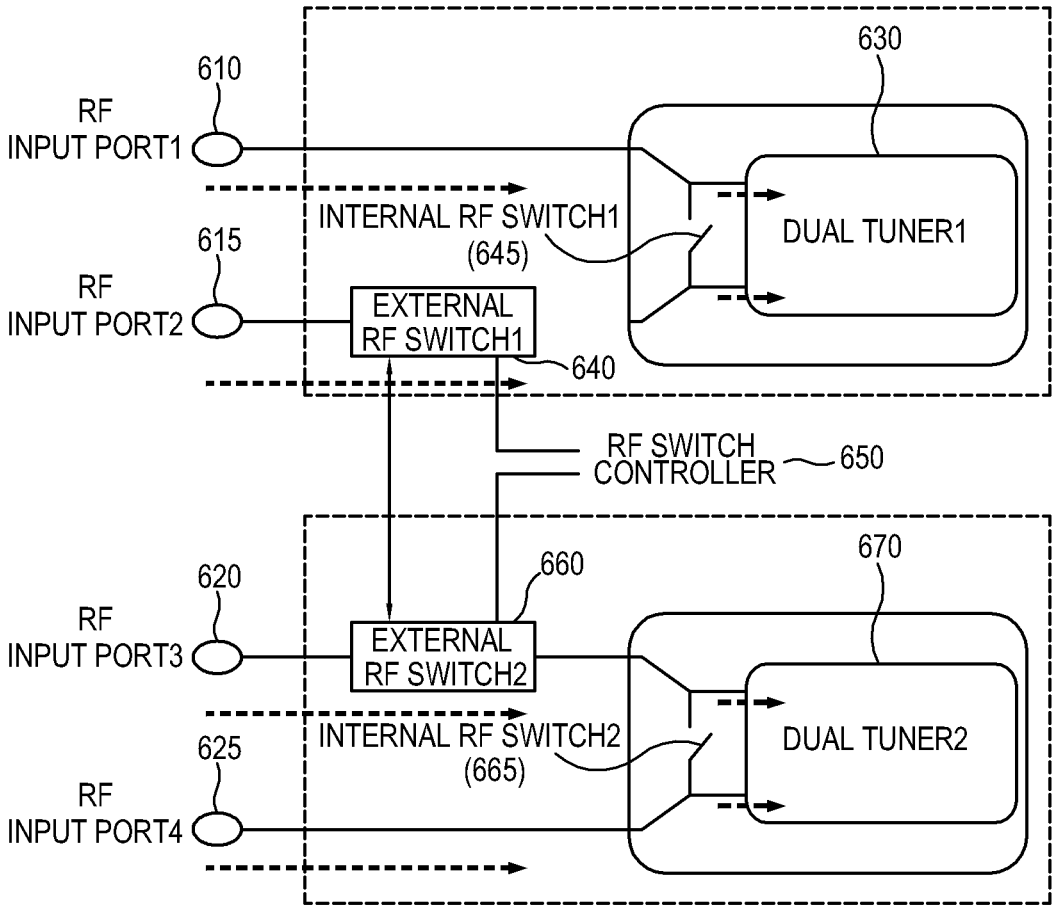
FIG. 5 shows an example where broadcasting signals are input to respective tuner through a plurality of RF input ports in the set-top box according to an exemplary embodiment.

In particular, an example shown in FIG. 5 will be described. FIG. 5 shows an example where broadcasting signals are input to respective tuners through a plurality of RF input ports in the set-top box according to an exemplary embodiment. An RF input port1 610 and an RF input port2 615 correspond respectively to the first input port 310 and the first input port 311 of FIG. 3. A RF input port3 620 and an RF input port4 625 both correspond to the second input port 320 of FIG. 3. A dual tuner1 630 and a dual tuner2 670 correspond respectively to the first tuners 330 and 331 and the second tuner 370 of FIG. 3. An external RF switch1 640 and an external RF switch2 660 correspond to the first main switch 340 and the second main switch 360 of FIG. 3. A RF switch controller 650 corresponds to a portion of the controller 350 of FIG. 3.

As shown in FIG. 5, when the external RP switch2 660 becomes on, the RF input port1 610 and the RF input port2 615 are connected to the dual tuner2 670 so that the RF switch controller 650 can control a first broadcasting signal received in the RF input port1 610 and the RF input port2 615 to be input to the dual tuner2 670. Also, when the external RF switch2 660 becomes off, the RF input port1 610 and the RP input port2 615 are disconnected from the dual tuner2 670 so that the PP switch controller 650 can control a second broadcasting signal received in the RF input port3 620 and the RF input port4 625 to be input to the dual tuner2 670.

If a second broadcasting signal is not received in the plurality of second input port 320, the controller 350 may control the first main switch 340 and the second main switch 360 so that the second broadcasting signal received through one among the plurality of first input ports 310, 311, . . . , can be selectively input to the plurality of second tuner 370.

Figure 6:
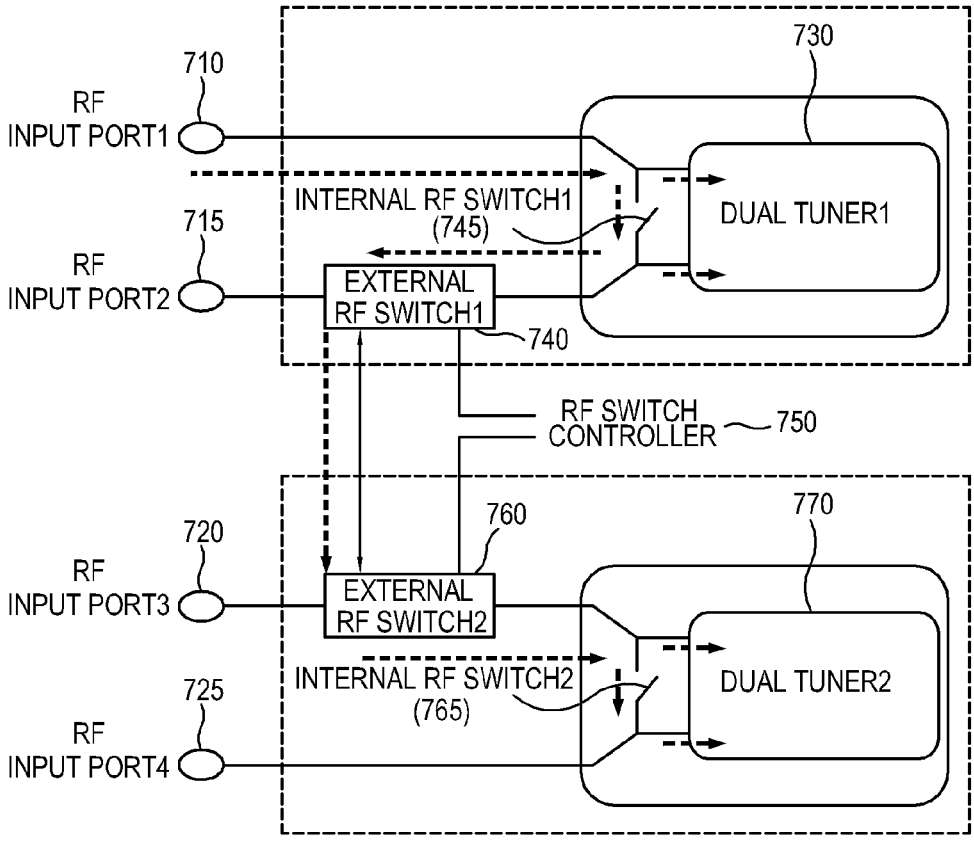
FIG. 6 shows an example where broadcasting signals are input to a plurality of tuners through one RE input port in the set-top box according to an exemplary embodiment.

In particular, an example shown in FIG. 6 will be described. FIG. 6 shows an example where broadcasting signals are input to a plurality of tuners through one RP input port in the set-top box according to an exemplary embodiment. As shown in FIG. 6, if a cable is connected to an RF input port1 710 and cables are not connected to an RF input port2 715, an RF input port3 720, and an RF input port4 725, a broadcasting signal is not received in the RF input port2 715, the RE input port3 720, and the RF input port4 725. In this case, the RF switch controller 750 controls an external RF switch1 740 and an external RE switch2 760 so that a second broadcasting signal received in the RF input port1 710 connecting with the cable can be connected to a dual tuner2 770. For example, while two dual tuners are connected and used, if a cable is connected to one input port among four input ports corresponding to four tuners in order to receive a broadcasting signal, the switch may be used so that the signal received through one cable can be input to all of the four tuners.

Also, the controller 350 may control the first main switch 340 and the second main switch 360 so that a first broadcasting signal received in the first input port 310, 311, . . . , can be input to the second tuner 370. For example, as shown in FIG. 6, the RF switch controller 750 controls the external RF switch1 740 and the external RE switch2 760 to become on so that a first broadcasting signal received in the RF input port1 710 or the RF input port2 715 can be input to the dual tuner 2 770.

Also, the controller 350 may control the first main switch 340 and the second main switch 360 so that a first broadcasting signal input to the first tuners 330, 331, . . . , can be input to the second tuner 320. As shown in FIG. 6, the RF switch controller 750 controls the external RF switch1 740 and the external RF switch2 760 to become on so that a first broadcasting signal input to the dual tuner1 730 can be input to the dual tuner 2 770.

Figure 7:
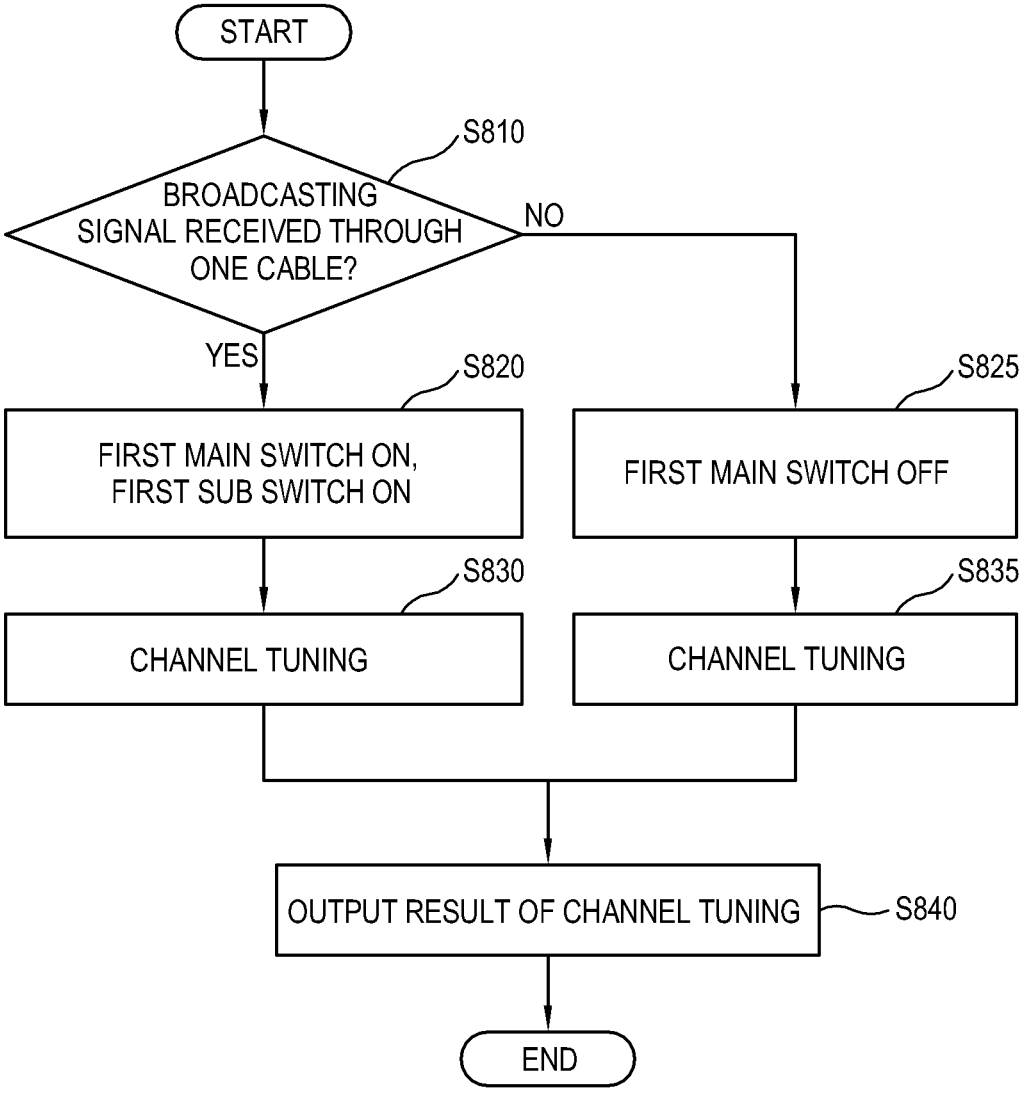
FIG. 7 is a flowchart showing operations of a broadcasting signal receiving apparatus according to an exemplary embodiment.

FIG. 7 is a flowchart showing operations of a broadcasting signal receiving apparatus according to an exemplary embodiment. As shown in FIG. 7, at operation S810 it is checked whether one cable is used for receiving a broadcasting signal. If the broadcasting signal is received through one cable, at operation S820 the first main switch and the first sub switch are closed (i.e., ON) so that all the tuners can operate even though the cable is connected to only one input port while many dual tuners are connected and used. Next, at operation S830 channel tuning is performed with regard to the broadcasting signal input in the operation S820. If the broadcasting signal is not received through one cable, at operation S825 the first main switch is opened (i.e., off) so that the broadcasting signals received through the input ports can be input to the respective tuners. Next, at operation S835 channel tuning is performed with regard to the broadcasting signal input in the operation S825. Finally, at operation S840 an error, a signal to noise ratio (SNR), etc., are output as a result of the channel tuning performed in the operation S830 or in the operation S835.

Figure 8:
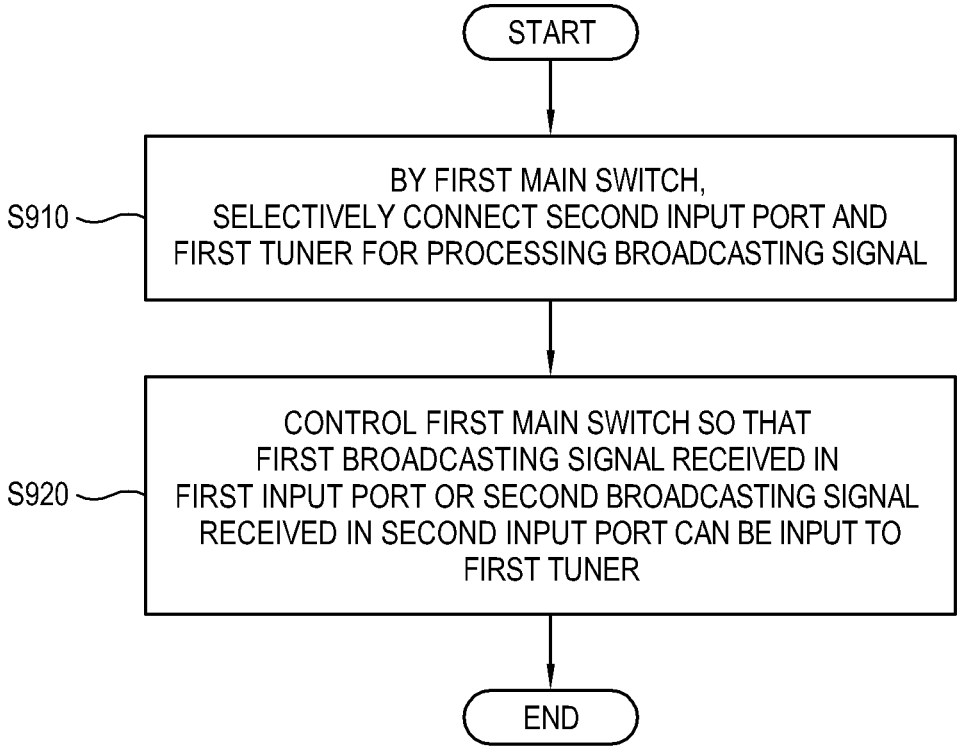
FIG. 8 is a flowchart showing a control method of a broadcasting signal receiving apparatus according to an exemplary embodiment.

FIG. 8 is a flowchart showing a control method of a broadcasting signal receiving apparatus according to an exemplary embodiment. As shown in FIG. 8, at operation S910, at least one first input port and a separately provided second input port are selectively connected to a first tuner for processing a broadcasting signal through a first main switch. Next, at operation S920 the first main switch is controlled so that a first broadcasting signal received in the first input port or a second broadcasting signal received in the second input port can be input to the first tuner.

According to an exemplary embodiment, there may be further provided an operation of selectively connecting the input terminals of the plurality of first tuners through a first sub switch, and an operation of controlling the first sub switch so that a broadcasting signal can be selectively input to the plurality of first tuners. At this time, there may be further provided an operation of controlling the first sub switch, if the first broadcasting signal is not received in one among the plurality of first input ports, so that the first broadcasting signal received in another one among the plurality of first input ports can be selectively input to the plurality of first tuners. For example, as shown in FIG. 4, if a cable is connected to the RF input port1 510 and no cable is connected to the RF input port2 515, the first sub switch becomes on so that the input terminals 531 and 532 of the dual tuner 530 can be connected to each other, thereby inputting the first broadcasting signal received in the RF input port1 510 to the input terminal 532 of the dual tuner 530.

According to another exemplary embodiment, there may be further provided an operation of selectively connecting the first input port with the second tuner for processing a broadcasting signal through a second main switch, and an operation of controlling the second main switch so that the first broadcasting signal or the second broadcasting signal can be input to the second tuner. For example, as shown in FIG. 5, if the external RF switch2 660 is closed (i.e., ON), the RF input port1 610 and the RF input port2 615 are connected to the dual tuner2 670 so that the RF switch controller 650 can control the first broadcasting signals received in the RF input port1 610 and the RF input port2 615 to be input to the dual tuner2 670.

According to another exemplary embodiment, at this time, there may be further provided an operation of controlling the first main switch and the second main switch, if the second broadcasting signal is not received in the plurality of second input ports, so that the second broadcasting signal received in one among the plurality of first input ports to be selectively input to the plurality of second tuners. For example, as shown in FIG. 6, if a cable is connected to only the RF input port1 710 and no cable is connected to the RF input port2 715, the RF input port3 720, and the RF input port4 725, the broadcasting signal is not received in the RF input port2 715, the RF input port3 720, and the RF input port4 725. In this case, the RF switch controller 750 controls the external RF switch1 740 and the external RF switch2 760 to become on so that the second broadcasting signal received in the RF input port1 710 connecting with the cable can be connected to the dual tuner2 770.

Also, there may be further provided an operation of controlling the first main switch and the second main switch so that the first broadcasting signal received through one of the first input ports can be input to the second tuner, and an operation of controlling the first main switch and the second main switch so that the first broadcasting signal input to the first tuner can be input to the second tuner.

As described above, according to an exemplary embodiment, the broadcasting signal receiving apparatus controls the first main switch so that the second broadcasting signal received in the second input port provided separately from at least one first input port can be input to the plurality of first tuners, thereby allowing the plurality of tuners to receive the broadcasting signal through the switch.

Also, even though a cable is connected to one input port among the plurality of input ports corresponding to the plurality of tuners, the switch may be used to operate all the plurality of tuners.

In an exemplary embodiment, any one of the controller 150, the controller 250, and the controller 350 may include at least one of a processor, hardware module, and a circuit. Further, any one of the first input port 110, 111, the second input port 120, the first input port 210, 211, the second input port 220, the first input port 310, 311, and the second input port 320 may include at least one of a processor, hardware module, and a circuit. Any one of the first main switch 140, the first main switch 240, the first sub switch 245, the first main switch 340, and the second main switch 360 may include at least one of a processor, hardware module, and a circuit. Finally, the first tuner 130, 131, the first tuner 230, 231, the first tuner 330, 331, and the second tuner 370 may include at least one of a processor, hardware module, and a circuit.

Although a few exemplary embodiments have been shown and described, it will be appreciated by those skilled in the art that changes may be made in these exemplary embodiments without departing from the principles and spirit of the invention, the scope of which is defined in the appended claims and their equivalents.

What is claimed is:

1. A broadcasting signal receiving apparatus comprising:

at least one first input port, and a at least one second input port which is provided separately from the at least one first input port, the at least one first input port being configured to receive a first broadcasting signal and the at least one second input port being configured to receive a second broadcasting signal;

a plurality of first tuners configured to process the broadcasting signal;

a plurality of second tuners configured to process the broadcasting signal;

a first main switch provided between the at least one first input port and one of the first tuners a second main switch provided between the at least one second input port and one of the plurality of second tuners;

a controller configured to control the first main switch and the second main switch, and a first sub switch configured to selectively connect a plurality of input terminals of the plurality of first tuners with each other, wherein the controller is configured to control the first sub switch so that the first broadcasting signal and the second broadcasting signal are selectively input to the plurality of first tuners, wherein the first main switch and the second main switch are connected to each other, wherein the controller controls the first main switch and the second main switch so that the first broadcasting signal received in the at least one first input port is selectively input to the plurality of second tuners or the second broadcasting signal received in the at least one second input port is selectively input to the plurality of first tuners, wherein the controller is configured to control the first sub switch so that the first broadcasting signal and the second broadcasting signal are selectively input to the plurality of first tuners, and wherein the controller is configured to control the first sub switch so that the first broadcasting signal received in another one first input port among the plurality of first input ports is selectively input to the plurality of first tuners in response to the first broadcasting signal not being received in one first input port among the plurality of first input ports.

2. The broadcasting signal receiving apparatus according to claim 1, wherein the controller is configured to control the first main switch and the second main switch so that the second broadcasting signal received in one first input port among the at least first input port is selectively input to the plurality of second tuners in response to the second broadcasting signal not being received in the at least one second input port.

3. The broadcasting signal receiving apparatus according to claim 1, wherein the controller is configured to control the first main switch and the second main switch so that the first broadcasting signal received in one first input port among the at least one first input port is input to the plurality of second tuners.

4. The broadcasting signal receiving apparatus according to claim 1, wherein the controller is configured to control the first main switch and the second main switch so that the first broadcasting signal input to the at least one first tuner is input to the at least one second tuner.

5. The broadcasting signal receiving apparatus according to claim 1, wherein the first broadcasting signal and the second broadcasting signal include a plurality of signals transmitted from a satellite.

6. The broadcasting signal receiving apparatus according to claim 1, wherein a plurality of broadcasting signals input to a plurality of first tuners are different from each other based on a voltage level.

7. The broadcasting signal receiving apparatus according to claim 1, further comprising an integrated circuit (IC) which comprises the at least one first tuner and the first sub switch.

8. A method of controlling a broadcasting signal receiving apparatus, the method comprising:

receiving a broadcasting signal from one of at least one first input port and separately provided at least one second input port;

selectively connecting a first main switch and a second main switch to each other, the first main switch provided between the first input port and one of a plurality of first tuners and the second main switch provided between the second input port and one of a plurality of second tuners;

controlling the first main switch and the second main switch so that a first broadcasting signal received in the first input port is selectively input to the second turner or a second broadcasting signal received in the second input port is selectively input to the first tuner, selectively connecting a plurality of input terminals of the plurality of first tuners with each other using a first sub switch;

controlling the first sub switch so that the first broadcasting signal and the second broadcasting signal are selectively input to the plurality of first tuners, and controlling the first sub switch so that the first broadcasting signal received in another first input port among the at least one input port is selectively input to the plurality of first tuners in response to the first broadcasting signal not being received in the one first input port among the at least one first input port.

9. The method according to claim 8, further comprising: controlling the first main switch and the second main switch so that the second broadcasting signal received in one first input port among the at least one first input port is selectively input to a plurality of second tuners in response to the second broadcasting signal not being received in the at least one second input port.

10. The method according to claim 8, further comprising: controlling the first main switch and the second main switch so that the first broadcasting signal received in one first input port among the at least one first input port is input to the plurality of second tuner.

11. The method according to claim 8, further comprising: controlling the first main switch and the second main switch so that the first broadcasting signal input to plurality of first tuner is input to the plurality of second tuner.

12. The method according to claim 8, wherein the first broadcasting signal and the second broadcasting signal include a plurality of signals transmitted from a satellite.

13. The method according to claim 8, wherein a plurality of broadcasting signals input to a plurality of first tuners are different from each other based on a voltage level.

14. The method according to claim 8, further comprising an integrated circuit (IC) which comprises the plurality of first tuner and the first sub switch.

* * * * *